United States Patent [19]

Gordon-Clark et al.

[11] 4,328,931

[45] May 11, 1982

[54] AUTOMATIC SPEED CONTROL OF A REWINDER

[75] Inventors: Richard H. D. Bullock, Jr., Media; H. William Fogle, Jr., Wallingford; Matthew R. Gordon-Clark, Swarthmore, all of Pa.

[73] Assignee: Scott Paper Company, Philadelphia, Pa.

[21] Appl. No.: 239,223

[22] Filed: Feb. 27, 1981

Related U.S. Application Data

[63] Continuation of Ser. No. 128,506, Mar. 10, 1980, abandoned.

[51] Int. Cl.[3] ..... B26D 7/06; B65H 17/02; B65G 17/16

[52] U.S. Cl. ..... 242/67.5; 83/417; 198/796; 226/119; 242/56 R

[58] Field of Search ..... 242/67.5, 67.2, 67.1 R, 242/56 R, 67.3 R, 75.5, 75, 75.51; 226/109, 118, 113, 119; 83/417; 198/796, 799; 221/10, 12, 13, 14

[56] References Cited

U.S. PATENT DOCUMENTS

| | | | |
|---|---|---|---|
| 2,769,600 | 11/1956 | Kwitek | 242/56 R |
| 3,016,780 | 1/1962 | Mosen | 83/417 |
| 3,222,004 | 12/1965 | Crowe | 242/67.5 X |
| 3,487,976 | 1/1970 | Matthews | 221/10 |
| 3,610,464 | 10/1971 | Loughry | 221/10 |
| 3,899,103 | 8/1975 | Shigemori | 221/10 |
| 3,934,837 | 1/1976 | Keilhack | 242/67.5 |
| 4,009,814 | 3/1977 | Singh | 226/113 |
| 4,142,626 | 3/1979 | Bradley | 198/796 |
| 4,247,019 | 1/1981 | Lerner | 221/10 |

*Primary Examiner*—Edward J. McCarthy
*Attorney, Agent, or Firm*—J. H. Yamaoka; J. W. Kane, Jr.

[57] ABSTRACT

A web finishing system which includes a web rewinder 10, an accumulator 64 and a log saw 80 includes means for automatically controlling the speed of the rewinder 10 based on the status of equipment in the system.

17 Claims, 5 Drawing Figures

LOAD ACC.
DISCHARGE ACC.
SAW
SAW RUN
ACCUMULATOR
ACC. FULL
ACC. HALF FULL
REWINDER
REWINDER
MOTOR
ENCODER
REJECT LOG
ANGLE CHANGE
REWINDER RUN/STOP
REWINDER COMMAND SPEED
ROLL A1 SIZE
ROLL A2 SIZE
10
11
12
14
16
18
20
22
24
26
30
32
34
36
37
38
39
40
42
44
45
46
50
51
52
54
56
58
60
62
64
66
68
70
72
74
76
78
80
82
84
86

AUTOMATIC SPEED CONTROL OF A REWINDER

This is a continuation of application Ser. No. 128,506, filed Mar. 10, 1980, abandoned.

TECHNICAL FIELD

This invention relates generally to paper finishing systems which include a rewinding machine for converting large parent rolls of paper into smaller diameter rolls, or logs, an accumulator which provides temporary storage of the logs, and a saw for cutting the logs into rolls having a length suitable for use by the consumer. This invention is specifically directed to an apparatus for automatically controlling the rewinding speed based on the status of the various machines in the finishing system.

BACKGROUND ART

In early paper finishing systems it was generally customary to manually set the speed of each machine so that it produced work pieces at a slightly lower rate than could be handled by the next machine in the line. Thus, a paper finishing system that included a rewinding machine for converting large parent rolls of paper into smaller diameter rolls, or logs, a saw for cutting the logs into lengths used by the consumer, and a wrapper for wrapping the rolls, the log saw speed would be set so that it could cut logs at a faster rate than could be produced by the rewinder, and the wrapper speed would be set so that it could wrap rolls at a faster rate than could be produced by the log saw. When a parent roll has been exhausted the rewinder must be shut down so that a new parent roll can be installed. In such a system, while the rewinder is down for a parent roll change, the flow of logs to the log saw is stopped and the log saw and the wrapper become idle.

It was recognized that the production rate of the finishing system could be increased by incorporating a temporary storage device, called a log accumulator, between the rewinder and the log saw. Such a finishing system is shown and described in U.S. Pat. No. 3,016,780 issued to D. W. Mosen on Jan. 16, 1962. One advantage of having an accumulator is that the rewinder can continue to produce logs even when the log saw is not operating, as the excess logs are stored in the accumulator. Another advantage is that the speed of the rewinder can be set so that it produces logs at a faster rate than can normally be handled by the log saw. If the speed of the rewinder is set properly, when the parent roll is exhausted, there will be a sufficient number of logs stored in the accumulator to allow continued operation of the log saw and wrapper while a new parent roll is placed on the rewinder.

In finishing systems that have an accumulator, there are occasions when the accumulator becomes almost full or full. This could happen, for example, if the saw were shut down for a period of time and the rewinder continued to produce logs. If the rewinder is set to produce logs at a faster rate than can be handled by the log saw, and the accumulator is almost full when the log saw comes back on line, it is possible to jam either the accumulator or the log saw and the rewinder will shut down which usually results in waste. If the rewinder shuts down several times during a relatively short period of time, there is a tendency for the finishing line operator to lower the rewinder speed thereby lowering the probability that the finishing system will ever reach a point where the rewinder can produce more logs than can be instantaneously handled by the accumulator and the log saw. Over the long term, this reduction in speed, although slight, can represent a significant reduction of the average flow rate of product through the finishing system.

It is, therefore, desirable to automatically control the speed of the rewinder to maintain a high flow rate of product through the finishing system. It is also desirable to take into account the status of the rewinder, accumulator and saw when automatically controlling the speed of the rewinder.

It is quite common for a finishing line operator to be responsible for operating two web rewinders. One responsibility of the operator is to replace an exhausted parent roll with a new parent roll. If it should happen that both parent rolls are exhausted at the same time, the first rewinder will be shut down for the time required to change the parent roll, but the second rewinder will be down for the time required to change two parent rolls. Thus, if it appears that both parent rolls will be exhausted at the same time, it would be desirable to automatically control the speed of the rewinders so that the parent rolls will not become exhausted at the same time.

DISCLOSURE OF INVENTION

In accordance with this invention, a web finishing system that includes a web rewinder and an accumulator includes means for automatically controlling the speed of the rewinder as a function of the status of the accumulator, one measure of which is the number of empty storage spaces in the accumulator. In another aspect of this invention, means are provided for automatically controlling the speed of the rewinder based on the status or efficiency of the rewinder. One example of a measure of the status or efficiency of the rewinder is the number of times the rewinder is shut down over a predetermined interval of time. Another example of a measure of the status or efficiency of the rewinder is the rate that it makes reject logs. Rewinder speed can also be used as a measure of the status or efficiency of the rewinder.

In another aspect of the invention, means are provided for measuring the diameter of the parent roll in the rewinder and the speed of the rewinder is automatically controlled based on the size of the parent roll and the number of empty storage spaces in the accumulator. In one described embodiment of the invention, the finishing system includes a second rewinder. Means are provided for also measuring the diameter of the parent roll in the second rewinder. The size of the parent rolls in both rewinders are monitored and the winding speed of at least one rewinder is automatically controlled to prevent both parent rolls from being exhausted at the same time.

In another aspect of the invention, the finishing system includes a log saw and means for monitoring the status of the log saw. The log saw status is a parameter that is also used to automatically control the speed of the rewinder.

BRIEF DESCRIPTION OF DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
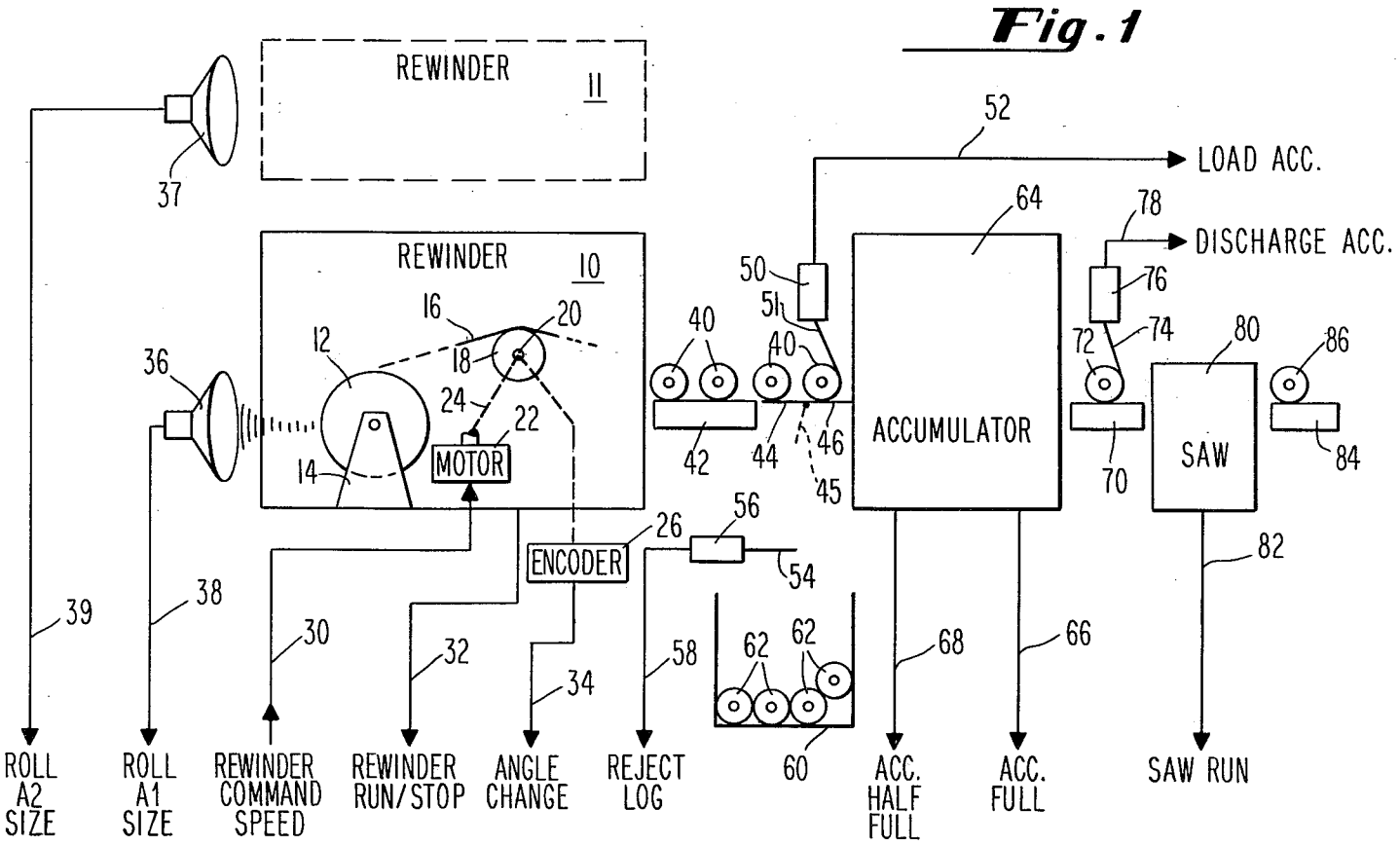
FIG. 1 is a block diagram of the equipment and sensors that are used in an embodiment of the finishing system.
Figure 2:
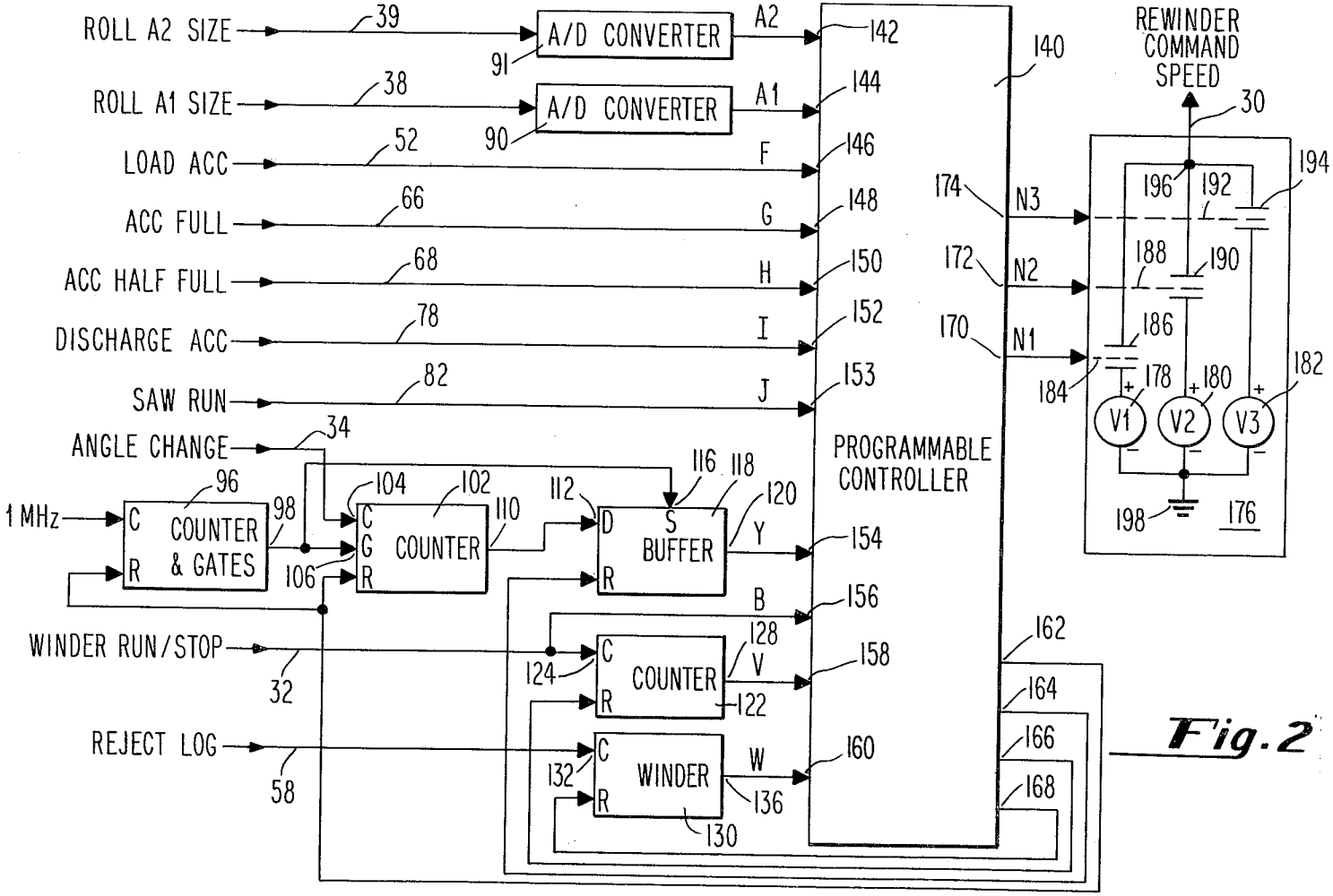
FIG. 2 is a block diagram of the equipment for controlling the finishing equipment shown in FIG. 1.

FIGS. 1 and 2 together comprise a block diagram of a finishing system in which the speed of a rewinder 10 is automatically controlled in accordance with this invention. The finishing equipment and sensors are shown in FIG. 1 and the rewinder 10 speed control equipment is shown in FIG. 2. Only those elements of rewinder 10 necessary for an understanding of the invention have been depicted in FIG. 1. A complete description of one type of rewinder 10 that can be automatically controlled in accordance with this invention is found in U.S. Pat. No. 2,769,600, issued Nov. 6, 1956 to E. M. Kwitek, et al. which is hereby incorporated by reference into this application. The rewinder 10 is a machine that converts a large parent roll 12 of a web material, such as toilet tissue or paper towels, into rolls 40, commonly referred to as logs, having a diameter that is suitable for use by a consumer. The parent roll 12 is rotatably mounted within a support stand 14. During the rewinding process, the web 16 from parent roll 12 is threaded over a bed roll 18 mounted on axle 20. Bed roll 18 is rotatably driven from motor 22 through appropriate belts and gears represented schematically by dashed line 24. The speed of rewinding the web 16 is determined by the angular velocity of the bed roll 18 which can be controlled by applying a suitable voltage to the input 30, designated REWINDER COMMAND SPEED, for motor 22. A REWINDER RUN/STOP signal 32 appears at an output of the rewinder 10. This REWINDER RUN/STOP signal 32 can be provided through a switch or relay closure that is activated by the on-off switch of rewinder 10. A shaft position encoder 26 is mechanically coupled to the axle 20 of bed roll 18. The output signal 34 of encoder 26 is a series of pulses wherein each pulse represents a fixed angle of rotation of the bed roll 18. As will be described later, these pulses can be processed to provide an indication of the actual speed of rewinder 10. A sensor, or transducer 36, provides an analog signal 38, designated ROLL A1 SIZE, that is representative of the diameter of parent roll 12. In one embodiment of the invention, the transducer 36 was a sonar gauge, model 3500D, manufactured by Stevens International, Inc., however, one skilled in the art will readily appreciate that mechanical, optical or other types of sensors or transducers can also provide the required indication of the diameter of parent roll 12.

The finishing system can include a second rewinder 11. Rewinder 11 can have its own automatic speed control equipment (not shown) which is identical to the automatic speed control equipment associated with rewinder 10 shown in FIGS. 1 and 2. Whether or not rewinder 11 has its own automatic speed control equipment, in one aspect of the invention, a second sensor, or transducer 37, provides an analog signal 39, designated ROLL A2 SIZE, that is representative of the diameter of the parent roll in rewinder 11 and which can be used to control the speed of rewinder 10.

Logs 40 that have been produced by rewinder 10 are transported by a conveyor 42 toward an accumulator 64. While the logs 40 are en route to the accumulator 64, improperly made logs 62, or rejects, are manually or automatically removed from the finishing system. Thus, when hinged member 44 is in the horizontal position, a properly made log 40 is allowed to proceed toward the accumulator 64, but when hinged member 44 swings downward to the position indicated by dashed line 45, a rejected log 62 falls into a waste bin 60. As a rejected log 62 falls into the waste bin 60, it trips a sensor 54 and circuit means 56 connected to sensor 54 provides an electrical signal 58, designated REJECT LOG, indicating the production of a rejected log 62. Properly made logs 40 continue to the input 46 of accumulator 64. As log 40 enters accumulator 64, it operates sensor 51 and circuit means 50 connected to sensor 51 provides an electrical signal 52, designated LOAD ACC, indicating that a log 40 has been loaded into the accumulator 64.

A detailed construction of log accumulator 64 is not shown as their construction is well known in the art, as represented, for example, by U.S. Pat. No. 4,142,626, issued Mar. 6, 1979, to John J. Bradley. Although the log accumulators depicted in FIG. 1 and described in the Bradley patent are first in, first out accumulators, the rewinder speed control equipment of this invention will work equally well with a last in, first out accumulator. Although not absolutely necessary, it has been found desirable to provide sensors in the accumulator 64 which provide a first signal 66, designated ACC FULL, indicating that the accumulator 64 is full and a second signal 68, indicating that some predetermined number of logs have been stored in accumulator 64. In the described embodiment, the signal 68, designated ACC HALF FULL, indicates that the accumulator 64 is half full. When a log 72 is discharged from the accumulator 64, it is transported by a conveyor 70 to a log saw 80 which cuts the logs into rolls having a length suitable for use by a consumer. As a log 72 is discharged from the accumulator 64, it operates a sensor 74 which is connected to circuit means 76 which provides a signal 78, designated DISCHARGE ACC, indicating that a log has been discharged from the accumulator 64. The saw 80 is a model 125, manufactured by Paper Converting Machine Company. A detailed description of the saw is not provided because it is not necessary for a description of this invention. The saw 80 has been modified to provide a saw status signal 82, designated SAW RUN. In one embodiment of the invention, the saw status signal 82 is an indication that the saw is running which can be provided by a switch or relay closure that is activated by the on-off switch of the saw 80. Examples of other signals representative of the status of saw 80 which can be used to control the speed of rewinder 10 are log saw waste and log saw cutting rate.

The individual rolls 86 produced by the saw 80 are transported by means of a conveyor 84 to either a wrapping machine (not shown) or to a packing machine (not shown).

FIG. 2 is a block diagram of the equipment that accepts the finishing system sensor signals and machine status signals and automatically controls the speed of rewinder 10. The analog signal 39, ROLL A2 SIZE, is converted into a digital number, A2, by an analog-to-digital converter 91. The digital number A2 is applied to an input 142 of a programmable controller 140. Programmable controller 140 is a Modicon 384 available from Gould, Inc. Similarly, the analog signal 38, ROLL A1 SIZE, is converted to a digital number, A1, by an analog-to-digital converter 90. The digital number, A1, is applied to an input 144 of programmable controller 140. The LOAD ACC signal 52 is applied as a digital signal, F, to an input 146 of programmable controller 140. The accumulator status signal 66, ACC FULL, is applied as a digital input, G, to an input 148 of programmable controller 140. The accumulator status signal 68, ACC HALF FULL, is applied as a digital signal, H, to an input 150 of programmable controller 140. The accumulator status signal 78, DISCHARGE ACC, is applied as a digital signal, 1, to an input 152 of programmable controller 140. The saw status signal 82, SAW RUN, is applied as a digital signal, J, to an input 153 of programmable controller 140.

The counter and gates circuitry 96 and counter 102 convert the ANGEL CHANGE signal 34 from encoder 26 into a digital number that is proportional to the actual speed of the rewinder 10. As shown in the figure, the counter portion of circuit 96 counts at a 1 megahertz rate. The gate portion of circuit 96 provides a gating signal 98 that has a predetermined time duration. This gating signal 98 is applied to a gate input 106 of counter 102. The ANGLE CHANGE pulses 34 from encoder 26 are applied to a count input 104 of counter 102. When counter 102 counts the number of ANGLE CHANGE pulses that occur over a predetermined period of time, the resultant count will be a digital number directly proportional to the actual speed of rewinder 10. If the duration of gate signal 98 is appropriately selected, the digital number in counter 102 will be a convenient multiple of either meters or feet per second. Since the programmable controller 140 may want to look at the number, Y, representing rewinder 10 speed while the number in counter 102 is changing, it has been found desirable to employ a buffer register 118. The digital output 110 of counter 102 is applied to a data input 112 of buffer register 118. The gate signal 98 of circuit 96 is applied to a set input 116 of buffer register 118. At the end of the predetermined count period for counter 102, as designated by the trailing edge of gate signal 98, the digital number determined by counter 102 is transferred into buffer register 118. The output 120 of buffer register 118 is a digital number, Y, representing the actual speed of rewinder 10 and is applied to input 154 of programmable controller 140. The counter in circuit 96 and counter 102 are both reset by a timing signal, which in one embodiment occurs every 2 minutes. This timing signal is provided at an output 162 of the programmable controller 140. The resetting of buffer register 118 occurs every 2 minutes and is also accomplished by a timing signal provided at an output 164 of programmable controller 140.

The WINDER RUN/STOP signal 32 is applied to a count input 124 of a counter 122 and is also applied as a digital signal, B, to an input 156 of programmable controller 140. The output of counter 122 is a digital number, V, that is applied to an input 158 of programmable controller 140. Counter 122 is reset once every minute by a timing signal provided at an output 166 of programmable controller 140. If rewinder 10 is running well, the number V in counter 122 will be either zero or one. If the rewinder 10 is running poorly and has been shut down several times in a short period of time, the number V in counter 122 can be a number greater than one. Thus, the number V is an indication of the status or efficiency of rewinder 10.

The REJECT LOG signal 58 is applied to the count input 132 of a counter 130. The output 136 of counter 130 is a digital number, W, that is applied to an input 160 of programmable controller 140. Counter 130 is reset every minute by a timing signal provided at an output 168 of programmable controller 140. The number W in counter 130 is a measure of the reject rate and is, therefore, an indication of the status or efficiency of rewinder 10.

The programmable controller 140 processes the sensor and status information it receives and generates three signals 170, 172, 174, designated N1, N2 and N3 respectively, representing a digital command speed for the rewinder 10. If the rewinder 10 is commanded to run at normal speed, the programmable controller 140 will cause a logical 1 to appear at output 172. If the rewinder 10 is commanded to run at low speed, which typically is in the range of 10 to 15% less than normal speed, but which could be as much as 25 to 35% less than normal speed, the programmable controller 140 causes a logical 1 to appear at output 170. If the rewinder 10 is commanded to run at high speed, typically 5 to 15% higher than normal speed, but which could be as much as 20 to 35% higher than normal speed, programmable controller 140 causes a logical 1 to appear at output 174. The N1, N2 and N3 signals are applied to a motor control circuit 176 which generates the proper analog REWINDER COMMAND SPEED signal 30. The motor control circuit 176 includes three voltage sources 178, 180, and 182, designated V1, V2 and V3 respectively. The negative terminals of voltage sources V1, V2 and V3 are connected to ground 198. The positive terminal of voltage source 178 is connected to node 196, representing the REWINDER COMMAND SPEED signal 30, through normally open relay contacts 186. Similarly, the positive terminal of voltage source 180 is connected to node 196 through normally open relay contacts 190, and the positive terminal of voltage source 182 is connected to node 196 through normally open relay contacts 194. The motor control circuit 176 includes circuitry, represented by dashed line 184, which causes relay contacts 186 to close when a logical 1 signal appears at output 170 of programmable controller 140. Similarly, motor control circuit 176 includes circuitry, indicated by dashed line 188, which closes relay contacts 190 when a logical 1 signal appears at output 172 of programmable controller 140, and circuitry, as indicated by dashed line 192, which closes relay contacts 194 when a logical 1 signal appears at output 174 of programmable controller 140. It is contemplated that voltage sources V1, V2 and V3 can be adjusted manually by the operator. The adjustment of voltage source V2 gives the operator control of the normal, or approximately the average, speed of the rewinder 10. Although programmable controller 140 has been described as providing three levels of commanded rewinder speed, it will be appreciated by those skilled in the art that the sensor and status information can be processed by programmable controller 140 in a manner that provides many more levels of rewinder speed command, in which case, a suitable motor control circuit 176 would be provided to generate the analog, REWINDER COMMAND SPEED signal 30. Furthermore, the functions performed by programmable controller 140 could be performed by a digital computer or by special purpose circuitry.

Figure 3:
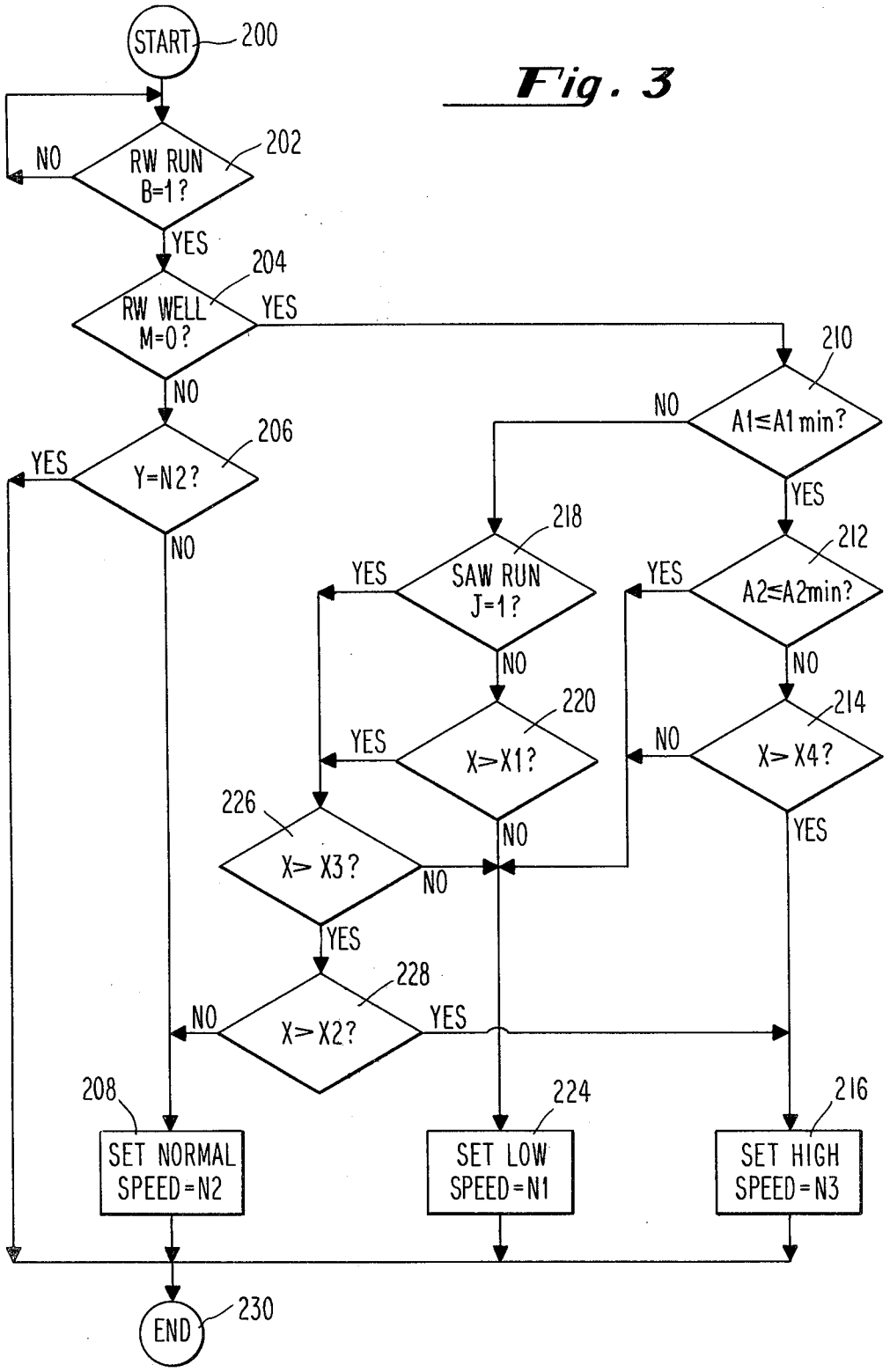
FIG. 3 is a flow diagram showing the logic performed by the control equipment depicted in FIG. 2.
Figure 4:
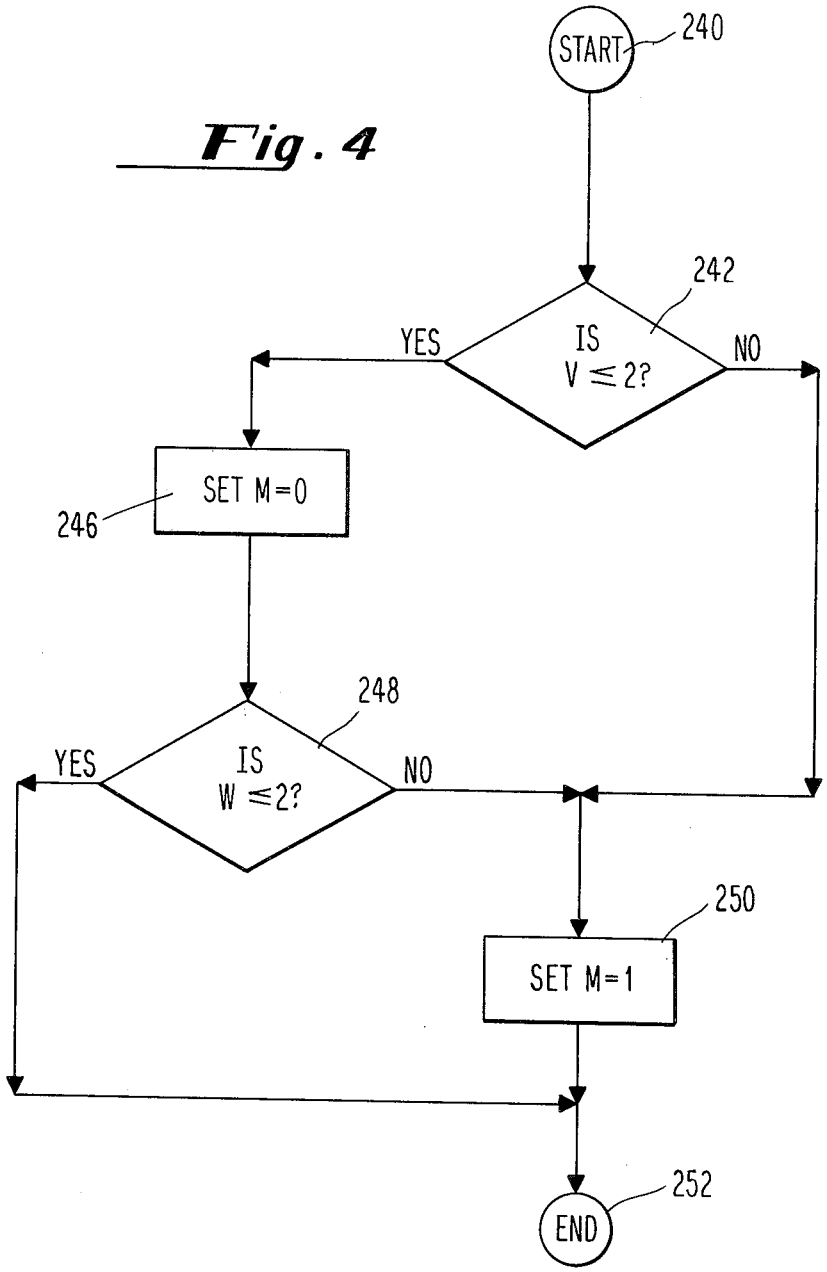
FIG. 4 is a flow diagram showing the logic performed by the control equipment of FIG. 2 to determine the efficiency of the rewinder shown in FIG. 1.
Figure 5:
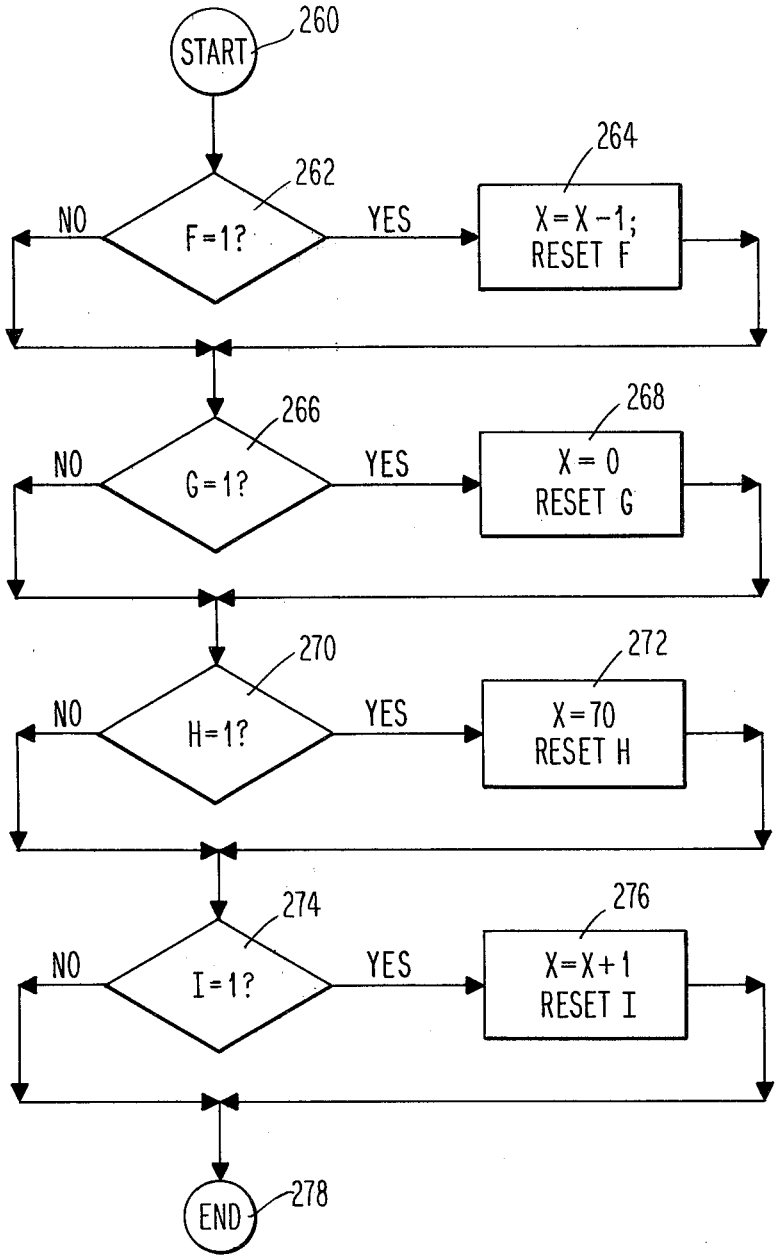
FIG. 5 is a flow diagram showing the logic performed by the control equipment of FIG. 2 for keeping track of the storage capacity of the accumulator shown in FIG. 1.

FIGS. 3, 4 and 5 are flow diagrams illustrating the logic performed by programmable controller 140 while processing the sensor and status information in order to select the normal, low or high speed command signals for motor control circuit 176.

In the discussion that follows, X represents the number of empty spaces available in accumulator 64. The numbers X1, X2 and X3 depend on system parameters such as accumulator size, etc. and in the described embodiment have the values 30, 60 and 20 respectively. The number X4 is that number of rolls that can be finished from a parent roll that has a diameter equal to A.

FIG. 3 is the flow chart of the main control routine for programmable controller 140. This control routine is executed about 10 to 15 times every second. The start of the routine is indicated by block 200.

Upon entering the main routine, a check is made as indicated by decision block 202, to see if the rewinder 10 is running. If the rewinder 10 is not running, the programmable controller 140 waits until the REWINDER RUN/STOP signal, B, indicates that the rewinder has been turned on. If the rewinder 10 is running, a rewinder status bit, M, is checked as indicated by decision block 204. If the rewinder status bit, M, is a logical one, indicating that rewinder 10 is not running well, blocks 206 and 208 command the rewinder 10 to operate at normal speed. Thus, the speed of the rewinder 10 is automatically controlled by the status or efficiency of the rewinder 10. If the rewinder status bit, M, is a logical zero indicating that the rewinder 10 is running well, programmable controller 140 performs decision block 210. The logic of decision blocks 210, 212 and 214 controls the speed of rewinder 10 so that the parent roll 12 in rewinder 10 does not become exhausted at the same time as the parent roll in rewinder 11. Thus, if the diameters of both parent rolls are less than A, block 224 is performed which commands rewinder 10 to run at low speed. If the diameter of parent roll 12 in rewinder 10 is less than A, and the diameter of the parent roll in rewinder 11 is greater than A, block 216 will command rewinder 10 to run at high speed if there are enough empty spaces in the accumulator 64 to accept the rolls, as determined by decision block 214, and will be operated at low speed if there are not enough empty spaces in the accumulator 64.

Decision blocks 218, 220 226 and 228 select the speed of rewinder 10 based on the status or efficiency of the saw and the status, or number of empty spaces available in accumulator 64, when the diameter of the parent roll 12 in rewinder 10 is greater than A. If the saw 80 is running, the rewinder 10 is commanded to wind at low speed if there are fewer than 21 empty spaces available in the accumulator 64, is commanded to wind at normal speed if there are between 21 and 60 empty spaces available in accumulator 64, or is commanded to wind at high speed if there are more than 60 empty spaces available in the accumulator 64. If the diameter of parent roll 12 in rewinder 10 is greater than A, and the saw 80 is not running, the rewinder 10 is commanded to wind at low speed if there are fewer than 30 empty spaces available in accumulator 64, is commanded to wind at normal speed if there are between 31 and 60 empty spaces available in accumulator 64, or is commanded to wind at high speed if there are more than 60 empty spaces available in accumulator 64.

Referring now to FIG. 4 there is shown a flow diagram of the subroutine for keeping track of the status or efficiency of rewinder 10. If the rewinder 10 is running well, the rewinder status bit, M, will be equal to a logical 0, and if rewinder 10 is running poorly, the rewinder status bit, M, will be set to a logical 1. As indicated by decision block 242, a check is made to see if rewinder 10 has been shut down more than twice during the past one minute. If it has been shut down an excessive number of times, this is an indication that the rewinder 10 is operating poorly and block 250 causes the rewinder status bit, M, to be set to a logical 1. If the rewinder 10 has not been shut down an excessive number of times, that is an indication that the rewinder is running properly and block 246 causes the rewinder status bit, M, to be set to a logical 0 and then proceeds to decision block 248. Block 248 checks the reject rate of rewinder 10. If more than two logs have been rejected since the start of a one minute interval, the rewinder is not performing well and the rewinder status bit, M, is set to a logical 1. If fewer than two logs have been rejected since the start of the last one minute interval, the rewinder 10 is considered to be running well and the rewinder status bit, M, is left equal to a logical 0.

FIG. 5 is a flow chart showing the subroutine that keeps track of the number of empty spaces in the accumulator 64. The start of the subroutine is indicated at block 260. As mentioned above, the variable X represents the number of empty spaces in the accumulator 64. Blocks 262 and 264 recognize the presence of the LOAD ACC signal, F, indicating that a log is being stored in the accumulator 64, and subtracts one from the number of empty spaces, X, in accumulator 64. Blocks 266 and 268 respond to the ACC FULL signal, G, and sets X equal to zero which means that there are no spaces available in accumulator 64. Blocks 270 and 272 respond to the ACC HALF FULL signal, H, and sets X equal to 70 which is one-half the storage capacity of accumulator 64. Blocks 274 and 276 respond to the DISCHARGE ACC signal, 1, by adding one to the number of empty spaces, X, in the accumulator 64. It is to be noted that blocks 266, 268, 270 and 272 are not absolutely necessary for programmable controller 140 to keep track of the number of empty spaces in accumulator 64. The logic represented by blocks 266–272 acts as a check on the value of the variable X in the event the programmable controller 140 fails to properly keep track of the number of empty spaces in the accumulator 64. It will also be appreciated that while the ACC FULL and ACC HALF FULL signals are convenient for the accumulator employed in the described system, any other convenient checkpoints could be employed.

Thus, a finishing system has been described that can include a web rewinder 10, an accumulator 64 and a saw 80. A programmable controller 140 automatically controls the speed of rewinder 10 based on the status of the system or on the status of the equipments that make up the system. Among the parameters that can control the speed of rewinder 10 are: the status of the rewinder 10, the efficiency of the rewinder 10, the status of the accumulator 64, the status of the saw 80, the size of the parent roll 12 in the rewinder 10 being controlled by programmable controller 140, and the size of the parent roll in a rewinder 11 that is adjacent to the controlled rewinder 10. Although the operator can establish the normal speed, which approximates the average speed, of the rewinder 10, the programmable controller 140 controls the instantaneous speed of the rewinder 10 to optimize the productivity of the entire finishing system.

While the present invention has been described with reference to a specific enbodiment thereof, it will be obvious to those skilled in the art that various changes and modifications may be made without departing from the invention in its broader aspects.

What is claimed is:

1. An improved web finishing system comprising a web rewinder for making logs from a parent roll and an accumulator for temporarily storing logs, wherein the improvement comprises:

(a) first means for generating a signal representing the number of empty storage spaces in the accumulator, and (b) circuit means responsive to the first means signal for automatically controlling the speed of the rewinder.

2. An improved web finishing system as recited in claim 1 additionally comprising second means for generating a signal representative of parent roll size wherein the circuit means is also responsive to the second means signal.

3. An improved web finishing system as recited in claim 1 or 2 wherein the web finishing system additionally comprises a log saw, said improvement additionally comprising means for generating a signal indicating the status or efficiency of the log saw and wherein the circuit means is also responsive to said log saw signal.

4. An improved web finishing system comprising a first web rewinder for making logs from a first parent roll, a second rewinder for making logs from a second parent roll and an accumulator for temporarily storing logs, wherein the improvement comprises:

(a) first means for generating a signal representing the size of the first parent roll;

(b) second means for generating a signal representing the size of the second parent roll;

(c) third means for generating a signal representing the number of empty storage spaces in the accumulator; and (d) circuit means responsive to the first, second and third means signals for automatically controlling the speed of the first rewinder thereby controlling when both parent rolls run out.

5. An improved web rewinder for making logs from a parent roll wherein the improvement comprises:

(a) first circuit means for generating a signal representative or the efficiency of the rewinder; and (b) second circuit means responsive to the first circuit means signal for automatically controlling the speed of the rewinder.

6. An improved web rewinder as recited in claim 5 wherein the first circuit means signal represents the rate rejected logs are made by the rewinder.

7. An improved web rewinder as recited in claim 5 wherein the first circuit means signal is the number of times the rewinder is shut down during a predetermined period of time.

8. An improved web finishing system comprising a web rewinder for making logs from a parent roll and an accumulator for temporarily storing logs, wherein the improvement comprises:

(a) first means for generating a signal representative of the status of the rewinder;

(b) second means for generating a signal representing the status of the accumulator; and (c) circuit means responsive to the first and second means signals for automatically controlling the speed of the rewinder.

9. An improved web finishing system as recited in claim 8 additionally comprising third means for generating a signal representative of parent roll size wherein the circuit means is also responsive to the third means signal.

10. An improved web finishing system as recited in claim 8 or 9 wherein the web finishing system additionally comprises a log saw, said improvement additionally comprising a fourth means for generating a signal indicating the status or efficiency of the log saw and wherein the circuit means is also responsive to said log saw status signal.

11. An improved web finishing system as recited in claim 10 wherein the first circuit means signal represents the rate rejected logs are made by the rewinder.

12. An improved web finishing system as recited in claim 10 wherein the first circuit means signal is the number of times the rewinder is shut down during a predetermined period of time.

13. An improved web finishing system as recited in claim 10, wherein the web finishing system additionally comprises a second web rewinder for making logs from another parent roll, said improvement additionally comprising: fifth means for generating a signal representative of said other parent roll size and wherein the circuit means is responsive to the fifth means signal and controls the speed of the first rewinder thereby controlling when both parent rolls run out.

14. In an article handling system, the combination comprising:

(a) an accumulator adapted to receive and temporarily store articles;

(b) first article handling means for providing articles, at a controllable rate, to be stored in the accumulator;

(c) first circuit means for generating a signal representing the number of empty storage spaces in the accumulator; and (d) second circuit means responsive to the first circuit means signal for controlling the output rate of the first article handling means.

15. The article handling system of claim 14 further comprising:

(a) a second article handling means adapted to receive stored articles from the accumulator; and (b) third circuit means for generating a signal indicating a status of the second article handling means, and wherein the second circuit means is also responsive to the third circuit means signal.

16. In an article handling systems, the combination comprising:

(a) an accumulator adapted to receive and temporarily store articles;

(b) first article handling means for providing at a controllable rate, articles to be stored in an accumulator;

(c) first circuit means for generating a signal representing a status of the first article handling means;

(d) second circuit means for generating a signal representing a status of the accumulator; and (e) third circuit means responsive to the first and second circuit means signals for controlling the rate at which articles are provided by the first article handling means.

17. The article handling systems as recited in claim 16 further comprising:

(a) a second article handling means adapted to receive stored articles from the accumulator; and (b) fourth circuit means for generating a signal indicating a status of the second article handling means, and wherein the the third circuit means is also responsive to the fourth circuit means signal.

* * * * *